United States Patent [19]

Gerrick

[11] 4,453,273

[45] Jun. 12, 1984

[54] NECKTIE PROTECTOR

[76] Inventor: H. George Gerrick, 200 Warwick Dr., Pittsburgh, Pa. 15241

[21] Appl. No.: 445,924

[22] Filed: Dec. 1, 1982

[51] Int. Cl.[3] ..... A41D 27/12

[52] U.S. Cl. ..... 2/46; 2/144

[58] Field of Search ..... 2/46, 144

[56] References Cited

U.S. PATENT DOCUMENTS 2,429,502 10/1947 Ballenger ..... 2/46

2,747,192 5/1956 Katz ..... 2/46

*Primary Examiner*—Doris L. Troutman

*Attorney, Agent, or Firm*—Webb, Burden, Robinson & Webb

[57] ABSTRACT

A necktie protector comprises a flat flexible plastic envelope having two identical elongate flat plastic faces joined at the long edges thereof and not being joined at the short edges thereof. Flat plastic tabs extend centrally from two adjacent unjoined edges.

6 Claims, 2 Drawing Figures

NECKTIE PROTECTOR

DESCRIPTION

BACKGROUND

Neckties are becoming more and more expensive and there exists a need for an unobtrusive necktie protector to be used even during elegant dining occasions. The necktie protector must be easy to use so that the user can nonchalantly put it in place and remove it. It should be disposable and therefore made of inexpensive materials and by an inexpensive process. Most importantly, since it will be provided in fancy public restaurants (as napkins are now provided) it must have no potential for injuring the user either by having sharp edges or pins or by parts that may fall free into the user's food.

The basic problem of protecting the necktie has been addressed over and over. See, for example, U.S. Pat. Nos. 2,131,023; 2,423,581; 2,714,719; 2,747,192; 2,915,757; 3,085,247; 3,618,138; 3,714,669; 3,763,496; and 3,833,937. Each and every device disclosed in the prior art patents noted above has a major drawback: it requires either snaps, hooks, flat strips of pliable metal, soft wire, or adhesive contacts to hold the protector in place. These devices greatly increase the cost of manufacture and often provide a potential for danger to the user.

SUMMARY OF THE INVENTION

It is an object of this invention to provide a tie protector that requires no snaps, wires, rigid or even semi-rigid parts.

It is a further object of this invention to provide an easily mounted and unobtrusive necktie protector that could be used in even the most elegant settings without detracting from the formality of the occasion.

It is an object of this invention to provide a throw-away necktie protector that is made of one soft, plastic material and is inexpensive to manufacture.

Briefly according to this invention, there is provided a necktie protector comprising a flat plastic envelope having two identical elongate flat plastic faces. The long edges of the elongate flat plastic faces are joined together. The short edges of the elongate flat plastic faces are not joined. Flat plastic tabs extend centrally from two adjacent unjoined edges. Preferably the envelop is fabricated from a flexible plastic having a thickness between 0.0008 and 0.002. Preferably, the plastic is a polyolefin and most preferably a polyethylene.

It is further preferred that the necktie protector according to this invention be fabricated from a plastic tube that is pressed to form two flat faces. In a preferred embodiment, the necktie protector comprises flat faces that are rectangular and have dimensions of about four inches by eighteen inches and the tabs are about one inch by two inches being of the same material as the flat faces.

THE DRAWINGS

Further features and other objects and advantages of this invention will become apparent from the following detailed description made with reference to the drawings.

FIG. 1 is an isometric view of a necktie protector according to this invention; and FIG. 2 is a front view of a necktie protector according to this invention with the location of the necktie indicated inside by dashed lines.

DESCRIPTION OF THE PREFERRED EMBODIMENT

Figure 1:
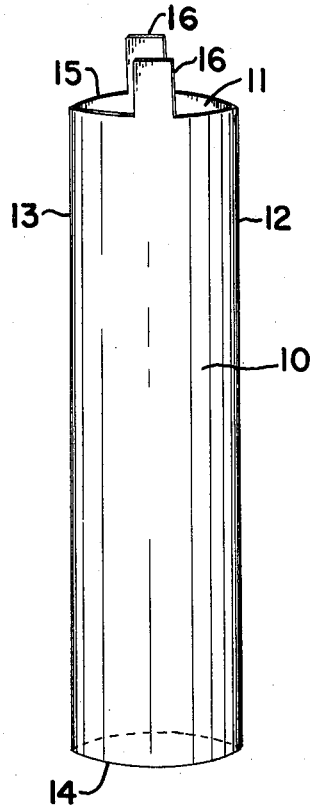

Referring now to FIG. 1 there is shown an isometric view of a necktie protector according to this invention wherein one flat face 10 is joined to another flat face 11 at edges 12 and 13. The short edges 14, 15 of the flat faces are unjoined. Extending from two adjacent short edges are tabs 16. The tabs are spaced centrally between the extensions of the long edges 12 and 13. Preferably, the tie protector is manufactured from a tubular plastic material having a thickness of about 0.0015. At this thickness, the polyethylene plastic material is sufficiently rigid to enable easy emplacement of the tie protector and with avoidance of many wrinkles in the plastic envelope. A much thicker plastic would not be desirable as it would unnecessarily increase the cost of the materials. It would also tend to reflect more light making the tie protector less unobtrusive. Preferably the tie protector will be fabricated of clear or transparent plastic material.

In a preferred manufacturing technique, the tubular plastic stock material is pressed to form two flat faces. It is then cut to length and to provide for the tabs.

The tie protector is slid into position by simply grabbing one of the tabs with a thumb and forefinger and gently threading the free ends of the tie into the interior of the envelope. The tie once started into the envelope will slide freely therein when the tab is drawn upward. The tab is then simply and easily tucked between the collar and the neck thus holding the necktie protector in place covering the knot as well as the portion of the necktie extending therebelow. It is an advantage of this invention to provide two tabs even though only one tab is used. If only one tab were in place a user could inadvertently draw the tie into the envelope with the tab at the rear of the tie and then be required to remount the tie protector causing unnecessary embarrassment at the dinner table.

Figure 2:
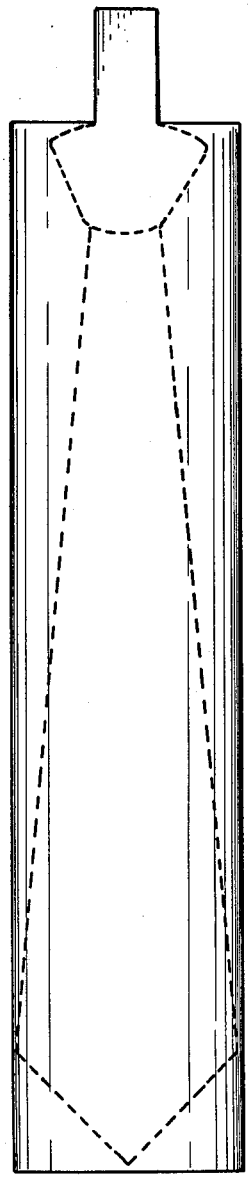

FIG. 2 shows a front view of the tie protector with the relative dimensions shown. Preferably the long dimension is about eighteen inches and the narrow dimension about four inches.

It is a further advantage according to this invention, as the tie protector has flat surfaces, that a neat emblem may be printed on the tie protector by conventional printing; for example, silk screening techniques. Thus, the logo of the restaurant providing the tie protector to its customers might be printed on the flat surface of the tie protector.

Having thus described my invention with the detail and particularity required by the Patent Laws, what is desired protected by Letters Patent is set forth in the following claims.

I claim:

1. A necktie protector being free of wires, buttons, snaps, and strings consisting of a flat flexible plastic envelope sized to just enclose the portions of a necktie hanging from the knot therein and having two identical elongate flat plastic faces joined at the long edges thereof and not being joined at the short edges thereof and there being flat plastic tabs extending centrally from two adjacent unjoined edges and being integral with the flat plastic faces.

2. The necktie protector according to claim 1 wherein the envelope is fabricated from polyolefin plastic having a thickness between 0.0008 and 0.002.

3. The necktie protector according to claim 2 wherein the envelope is fabricated of clear material.

4. The necktie protector according to claim 2 wherein the envelope is fabricated as a plastic tube and is then pressed to form two flat plastic faces.

5. The necktie protector according to claim 2 wherein the flat spaces are about four inches by about eighteen inches.

6. The necktie protector according to claim 4 wherein the tabs are about one inch by two inches and are centrally attached to adjacent short edges of the flat plastic faces.

* * * * *